US009545709B2

(12) United States Patent
Anitua Aldecoa

(10) Patent No.: US 9,545,709 B2
(45) Date of Patent: Jan. 17, 2017

(54) WRENCH FOR PROVIDING A FIXED ADJUSTABLE MAXIMUM TORQUE

(71) Applicant: BIOTECHNOLOGY INSTITUTE, I MAS D, S.L., Vitoria (ES)

(72) Inventor: Eduardo Anitua Aldecoa, Vitoria (ES)

(73) Assignee: BIOTECHNOLOGY INSTITUTE, I MAS D, S.L., Vitoria (Alava) (ES)

( * ) Notice: Subject to any disclaimer, the term of this patent is extended or adjusted under 35 U.S.C. 154(b) by 182 days.

(21) Appl. No.: 14/152,483

(22) Filed: Jan. 10, 2014

(65) Prior Publication Data

US 2014/0190320 A1 Jul. 10, 2014

Related U.S. Application Data

(62) Division of application No. 12/619,079, filed on Nov. 16, 2009, now abandoned.

(30) Foreign Application Priority Data

Nov. 14, 2008 (ES) ..... 200803254

(51) Int. Cl.
*B25B 23/142* (2006.01)
*B25B 13/46* (2006.01)

(52) U.S. Cl.
CPC ..... *B25B 23/1427* (2013.01); *B25B 13/463* (2013.01)

(58) Field of Classification Search
CPC ..... B25B 23/14; B25B 23/1427; B25B 13/463
USPC ..... 81/477, 475, 478
See application file for complete search history.

(56) References Cited

U.S. PATENT DOCUMENTS

| | | | | |
|---|---|---|---|---|
| 1,303,595 A | | 5/1919 | Rifflard | |
| 2,300,652 A | | 11/1942 | Cooney | |
| 2,371,901 A | * | 3/1945 | Livermont | B25B 23/1427 81/477 |
| 2,400,205 A | | 5/1946 | Livermont | |
| 2,400,978 A | * | 5/1946 | Collins | B25B 23/1427 116/212 |
| 2,441,038 A | * | 5/1948 | Siesel | F16D 7/048 81/477 |

(Continued)

FOREIGN PATENT DOCUMENTS

| | | | |
|---|---|---|---|
| GB | 1436492 | A | 5/1976 |
| WO | 2006029542 | A1 | 3/2006 |

*Primary Examiner* — Hadi Shakeri
(74) *Attorney, Agent, or Firm* — Browdy and Neimark, PLLC

(57) ABSTRACT

Wrench (1) for providing a maximum torque to an external part, characterized in that it comprises at least one elongated metal part (3) provided with a fixed end (4) and a pusher end (5), and which also comprises a torque-applying head (6) upon which the pusher end (5) acts, wherein the elongated metal part (3) is capable of bending when a torque is applied with the wrench, and wherein the elongated metal part (3) reaches a maximum bending point that determines the maximum torque provided by the wrench (1). The inventive wrench (1) is easier to use than conventional spring-based wrenches as the force required to adjust the torque is minimal and independent of the torque value to which the wrench is adjusted. It is also capable of providing higher torque values.

5 Claims, 7 Drawing Sheets

(56) References Cited

U.S. PATENT DOCUMENTS

| | | | | | |
|---|---|---|---|---|---|
| 3,633,418 | A | * | 1/1972 | Larson | B25B 23/1427 73/862.21 |
| 3,670,602 | A | | 6/1972 | Van Hoose | |
| 3,701,295 | A | | 10/1972 | Mende | |
| 3,722,316 | A | | 3/1973 | Hawkins et al. | |
| 3,786,699 | A | | 1/1974 | Kobayashi | |
| 4,827,813 | A | | 5/1989 | Ruland | |
| 5,535,867 | A | * | 7/1996 | Coccaro | F16D 43/2024 81/477 |
| 5,557,994 | A | | 9/1996 | Nakayama | |
| 6,276,243 | B1 | | 8/2001 | Jenkins | |
| 7,597,032 | B2 | | 10/2009 | Baumgartner | |
| 8,317,791 | B2 | | 11/2012 | Phan | |

* cited by examiner

WRENCH FOR PROVIDING A FIXED ADJUSTABLE MAXIMUM TORQUE

TECHNICAL FIELD

The invention relates to a wrench capable of providing a fixed or adjustable maximum torque to an external part (a screw, a nut, etc.) and cause said part to rotate.

PRIOR ART

Wrenches designed to provide a fixed or adjustable maximum torque to an external part (a screw, a nut, etc.) are essentially manual tools that are used to tighten or loosen external parts that, because of their mechanical properties or their operating conditions, require a very specific tightening torque or a tightening torque that does not exceed a specific value. Usually, these types of wrenches comprise an elastic member with a preload that varies according to the tightening torque required. Two types of wrenches are used at present: torque-indicating wrenches and torque-limiting wrenches.

Torque-indicating wrenches feature a visual scale that allows the user to select the torque to be applied on the external part. This type of wrench (examples of which are described in U.S. Pat. No. 3,670,602 and U.S. Pat. No. 4,827,813) has an indicator that makes torque selection easier.

Torque-limiting wrenches (examples of which are described in U.S. Pat. No. 3,701,295, GB1436492 and WO2006/029542A1) are wrenches that allow the provision of a specific or fixed torque only. This type of wrench may be adjustable (e.g. GB1436492), in other words the wrench may allow to select the magnitude of the torque.

Known wrenches present certain drawbacks such as the fact that they are difficult to use, cannot be used in a healthcare environment, and that the user has to exert a great deal of effort in order to apply the torque, etc.

In specific terms, spring-based wenches can be difficult to use because the higher the torque value the user wishes to adjust the wrench to, the greater amount of effort the user has to make to adjust the wrench (select the torque value). As a result, high torque values cannot be achieved in spring-based wrenches as this would require exerting an impossible amount of effort. In addition, spring-based wrenches suffer from what is known as "creep" (an increase in the deformation of a material when constant stress is applied to it), which causes the spring to become less tense and alters the torque scale.

This invention aims to resolve these drawbacks affecting existing wrenches.

BRIEF DESCRIPTION OF THE INVENTION

It is an object of the invention to provide a wrench that allows a maximum torque to be applied to a part (a screw, a nut, etc.) for the purpose of making the part rotate, wherein the torque provided by the wrench is limited by the controlled bending of certain internal elongated metal parts of the wrench. The inventive wrench thus comprises at least one elongated metal part provided with a fixed end and a pusher end, wherein the pusher end acts on a torque-applying head. The elongated metal part is capable of withstanding bending when torque is applied with the wrench. As the applied torque increases, the bending increases, thus increasing the force that the elongated metal part exerts on the torque-applying head. At a given moment, the elongated metal part reaches a maximum specific bending point, at which point the wrench provides its maximum torque. The maximum torque is thus determined by the maximum bending of the elongated metal part.

In one embodiment of the invention, the pusher end pushes a catch comprised in the torque-applying head. When the elongated metal part reaches the maximum bending point, the pusher end exerts a force on the torque-applying head that is high enough so that the torque-applying head jumps to the next position, thus limiting the torque provided by the wrench. The torque-applying head preferably emits a "click" sound when it jumps to the next position, warning the user that the wrench has reached its maximum torque.

In another embodiment of the invention, the elongated metal part is comprised in a set of parts connected by means of an articulated joint to the torque-applying head. In this embodiment the point at which maximum torque has been reached is indicated by the set of parts rotating in relation to the torque-applying head to an angle of maximum rotation, and not by a "click" or other indication emitted by the torque-applying head, as in the preceding embodiment.

Various embodiments are contemplated depending on the bending length and the momentum of the elongated metal part. Embodiments are envisaged in which the bending length and the momentum are fixed, therefore leading to fixed maximum torque wrenches (wrenches whose maximum torque is not user-adjustable). Alternatively, embodiments are envisaged in which either the bending length or the momentum is variable (user adjustable), and which, therefore, provide wrenches with an adjustable maximum torque. Embodiments are also contemplated in which both the bending length and the momentum are adjustable.

The inventive wrench offers certain advantages over conventional spring-based wrenches. Firstly, it is easier to use as the effort required to adjust the torque is minimal and does not depend on the torque value to which the wrench is adjusted. In conventional wrenches comprising springs, the user must exceed the preload force of the spring; given the fact that the greater the torque applied, the greater the deformation of the spring, the preload force also increases (as established in Hooke's Law), with the user thus being required to make an increasing amount of effort. In the wrench based on bending, however, there is no preload force that forces the user to make a greater effort. This also leads to an additional advantage, which is that the wrench based on bending can provide greater torques.

The graph of FIG. 20, which shows the force that has to be applied on the spring (the thick stepped line) and on the inventive elongated metal part (the thin curved line) in relation to the required movement or deformation of these parts, provides a better understanding of this phenomenon. As shown, the force the spring has to exert on the pusher end to generate a movement "d" equal to zero is very high, practically the maximum force. In the invention, however, the force on the pusher end in the rest position is zero as the elongated metal part is not bent. This effect ensures that barely any force is required to adjust the inventive wrench. The broken line indicates the maximum point of movement at which the ratchet jumps to the next tooth.

A further advantage of the invention is the fact that the material the elongated metal part is made from only works when torque is applied, thereby preventing "creep" from occurring.

BRIEF DESCRIPTION OF THE FIGURES

Details of the invention can be seen in the accompanying non-limiting figures.

DETAILED DESCRIPTION OF THE INVENTION

The wrench according to the invention, which allows a maximum torque to be provided to a rotatable external part (e.g. a screw, a nut, etc.), is characterised in that it comprises at least one elongated metal part that pushes a torque-applying head. The elongated metal part is capable of bending, with the result that when the load reaches a maximum amplitude due to the bending, the force exerted by the elongated metal part on the torque-applying head is not able to keep the torque-applying head in its position. The torque-applying head then jumps to a next position on a gearwheel, thereby reducing the torque again. As a result, the maximum bending load of the elongated metal part determines the maximum torque that the wrench is able to provide.

The wrench according to the invention may present a fixed maximum torque or an adjustable maximum torque, depending on whether the bending length and the momentum of the elongated metal part are fixed or variable.

Figure 1:
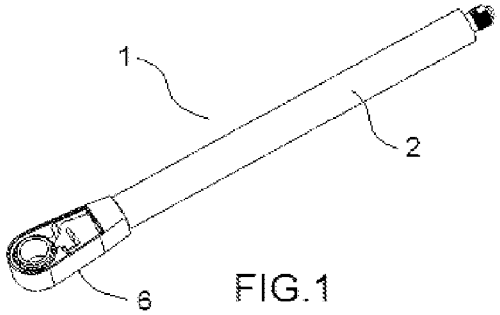
FIG. 1 shows a first embodiment of the wrench according to the invention, where the maximum torque that may be provided by the wrench is fixed.

FIG. 1 shows a first embodiment of the inventive wrench (1). In said embodiment, the maximum torque that the wrench (1) is able to provide is fixed. The wrench (1) comprises a fixed cover (2) that acts as a handle. A torque-applying head (6) is located on one end of the fixed cover (2). The torque-applying head (6) is a set of parts that enable virtually free rotation in one direction and which control (by means of the force exerted on a gearwheel) the maximum torque that may be applied in the other direction (the direction of tightening).

Figure 2:
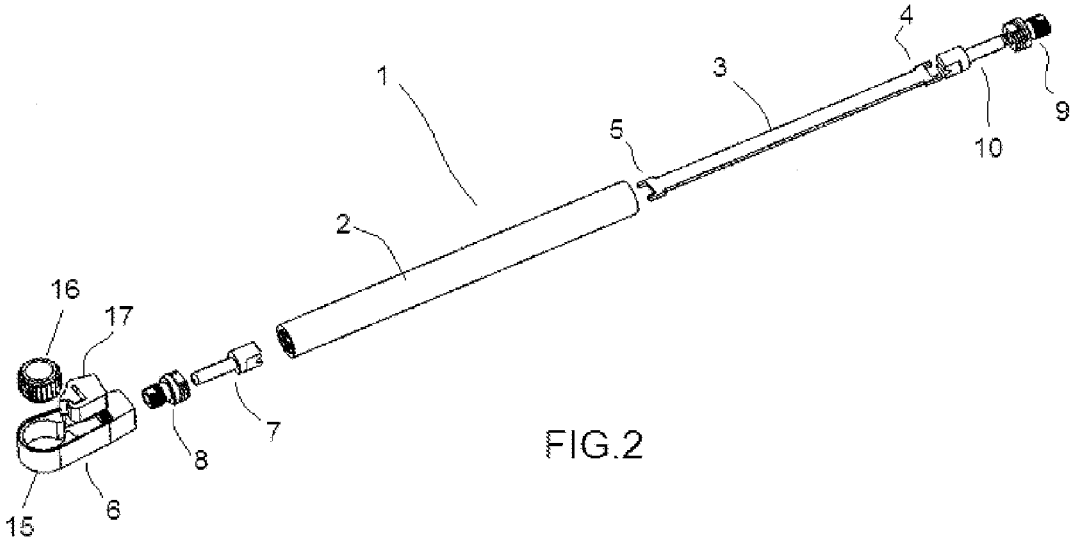
FIG. 2 shows an exploded view of the preceding wrench.

FIG. 2 shows an exploded view of the preceding wrench (1). In addition to the torque-applying head (6) and the fixed cover (2), the wrench (1) comprises an elongated metal part (3) that is housed inside the fixed cover (2). One of the ends of the elongated metal part (3) is a fixed end (4), while the opposite end is a pusher end (5). The pusher end (5) pushes a catch (17) of the torque-applying head (6). The torque-applying head (6) shown in the figure comprises a casing (15) that provides structural support to the torque-applying head (6) and maintains its internal parts isolated from the exterior, a gearwheel (16) that allows the relative rotation of the external part (a screw, etc.) in relation to the wrench (1) and the catch (17) whose function it is to apply the force exerted by the pusher (7) on the gearwheel (16) in an efficient manner.

In the embodiment shown, the pusher end (5) of the elongated metal part (3) pushes a pusher member (7), which in turn pushes the catch (17). On the other side, the fixed end (4) pushes another pusher member (10). A stopper member (8) connects the torque-applying head (6) to the fixed cover (2) and also limits the axial movement exerted on the pusher (7). Another stopper member (9) limits the movement of the pusher (10). The elongated metal part (3) is capable of bending when the catch (17) offers resistance, the wrench (1) working as follows: the user turns the wrench (1) with an increasing amount of torque, until the elongated metal part (3) reaches a specific load that causes bending. Eventually, the bending makes the pusher end (5) exert sufficient force on the catch (17) so that the catch (17) jumps to the next position of the gearwheel (16), thereby limiting the torque provided by the wrench (1).

Figure 3:
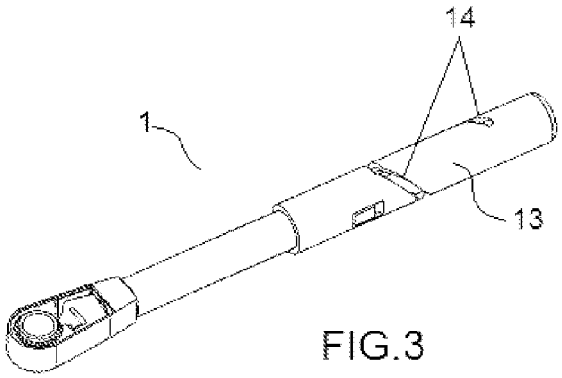
FIG. 3 shows a second embodiment of the wrench according to the invention, where the maximum torque that may be provided by the wrench is variable.
Figure 4:
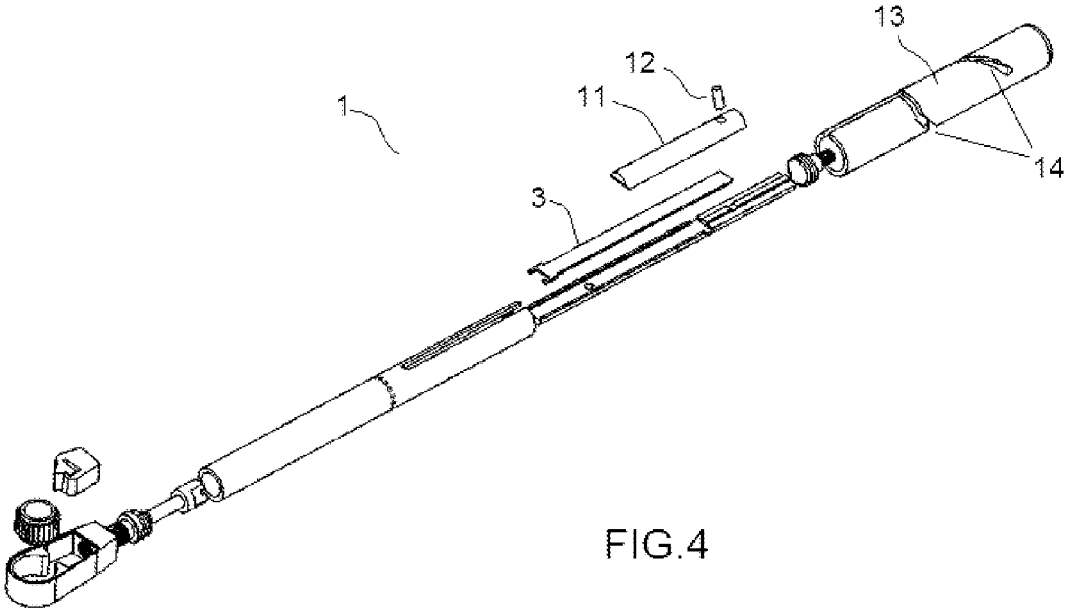
FIG. 4 shows an exploded view of the preceding wrench.

FIGS. 3 and 4 show a second embodiment of the wrench according to the invention, in which the maximum torque provided by the wrench is variable. In this case the wrench (1) further comprises means for varying the bending length of the elongated metal part (3) and, as a result, for varying the maximum torque provided by the wrench (1). In this case said means take the form of a sliding part (11) that presses the elongated metal part (3) at a variable point (P), the sliding part (11) being capable of being operated from the outside of the wrench (1).

Preferably, the sliding part (11) is operated from the outside of the wrench (1) by means of a bolt (12). Said bolt (12) is engaged with a moving cover (13), which enables said bolt (12) to be moved. For this purpose, the moving cover (13) preferably presents a helicoidal groove (14) in which the bolt (12) moves, with the result that the rotation of the moving cover (13) causes the bolt (12) to move axially.

Figure 5:
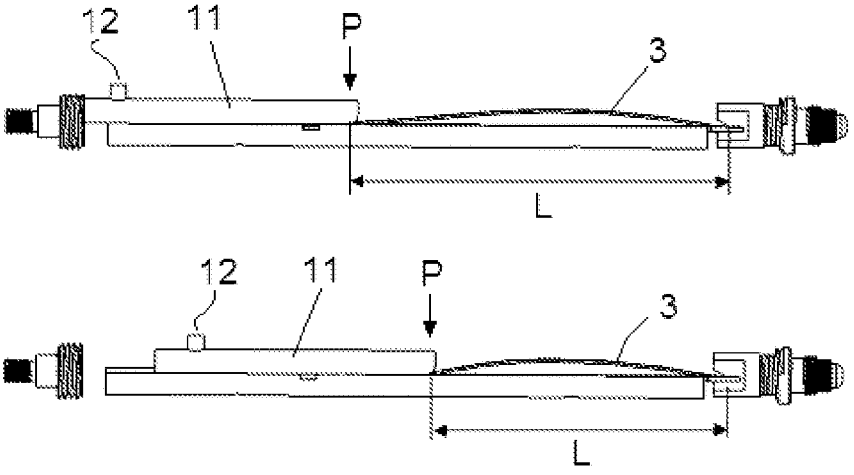
FIG. 5 shows two longitudinal cross-sectional views of the wrench of FIGS. 3 and 4.

FIG. 5 shows two longitudinal cross-sectional views of the wrench (1) of FIGS. 3 and 4. For sake of clarity not all parts are shown. The two views show how it is possible to select the required torque: depending on the angle at which the moving cover (13) is rotated, the sliding part (11) slides for a certain distance, altering the bending length (L) and, as a result, the torque applied. In the top figure the sliding part (11) is situated more to the left, with the point (P) being situated as a result at the furthest possible limit on the left. The bending length (L) of the elongated metal part (3) is therefore very large, with the maximum torque provided by the wrench (1) being relatively low as a result. In the bottom figure, the sliding part (11) and, as a result, the point (P) have moved a certain distance to the right. The bending length (L) is therefore smaller than in the top figure and the maximum torque provided by the wrench (1) is greater.

Figure 7:
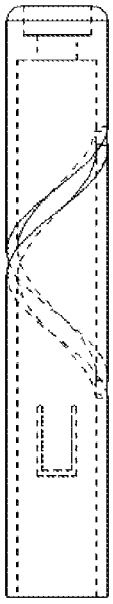
FIG. 7 shows the moving cover of FIG. 3.

In the wrench shown in FIGS. 3 and 4, the helicoidal groove (14) presents a fixed pitch. In other words, the relationship between the angle of rotation and the torque applied is not linear (equal increases in angle do not correspond with equal increases in torque). The moving cover (13) provided with a fixed-pitch helicoidal groove (14) can be seen in FIG. 7.

Figure 6:
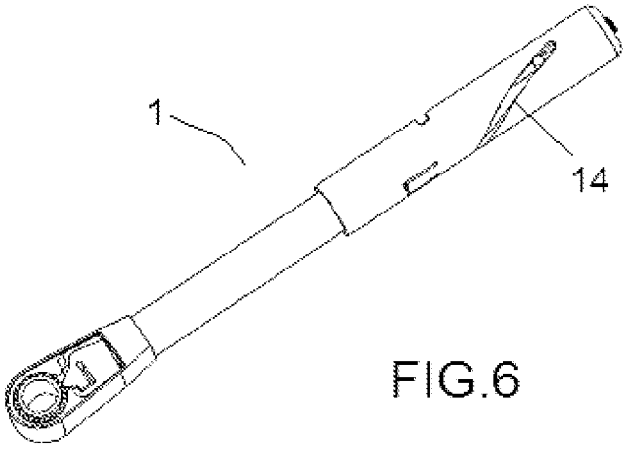
FIG. 6 shows a third embodiment of the wrench according to the invention, where the maximum torque that may be provided by the wrench is variable.
Figure 8:
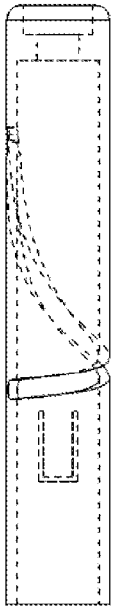
FIG. 8 shows the moving cover of FIG. 6.

Alternatively, FIG. 6 shows another embodiment of the wrench (1) according to the invention, wherein the maximum torque provided by the wrench is variable, as in FIGS. 3 and 4, but in which the helicoidal groove (14) presents a variable pitch. In this case, the relationship between the angle of rotation and the torque applied can be linear (equal angles of rotation correspond with equal variations in torque) or as the user requires. In other words, the provision of a variable pitch enables a linear relationship to be established between the angle of rotation of the moving cover (13) and the maximum torque provided by the wrench (1). This makes the adjusting of the maximum torque of the wrench (1) more of an intuitive process for the user. The moving cover (13) provided with a variable-pitch helicoidal groove (14) may be seen in FIG. 8.

Figure 9:
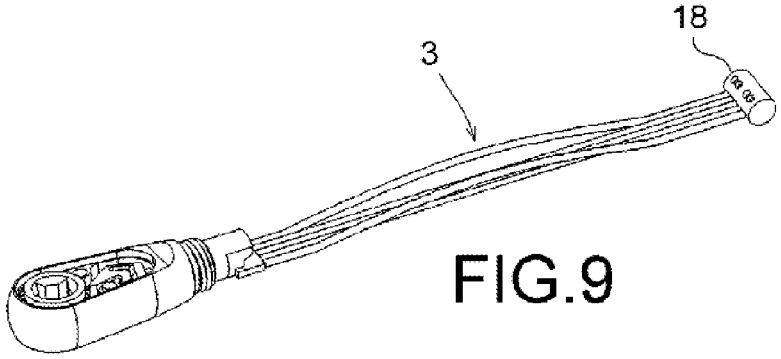
FIG. 9 shows an alternative embodiment of the elongated metal part.
Figure 10:
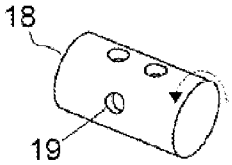
FIGS. 10 to 13 show the control part of FIG. 9 in a variety of positions.
Figure 11:
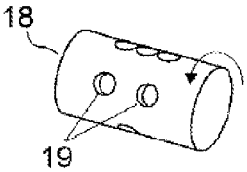
Figure 12:
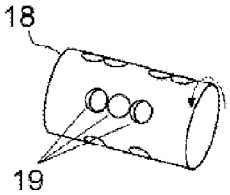
Figure 13:
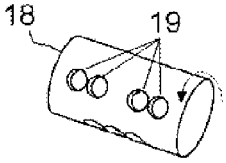

FIG. 9 shows an alternative embodiment of the invention. In this case the elongated metal part (3) is in fact a set of several elongated metal parts in the form of rods, in this example five rods in total. The wrench (1) comprises a control part (18) that allows the number of rods capable of being bent to be selected and therefore allows the maximum torque provided by the wrench (1) to be adjusted. In other words, the present embodiment enables the regulation of the momentum of the elongated metal part (3) formed by a set of several elongated metal parts. For this purpose, the control part (18) may rotate and comprises a series of holes (19) designed to allow certain rods to pass through so that said rods cannot bend. FIGS. 10 to 13 show the various positions that the control part (18) may adopt to enable the number of bendable rods to be varied and therefore enable the adjustment of the momentum of the set of rods (and the maximum torque of the wrench as a result). In FIG. 10 the control part (18) is situated in a position in which there is only one hole (19) aligned with the rods. As a result, the central rod does not bend whereas the other four rods (two on either side of the central one) do bend, the control part (18) acting as a stopper on the latter. In FIG. 11 the control part (19) has rotated to a position where there are two holes (19) aligned with the rods, with the result that three rods bend and two rods do not bend. In FIG. 12 the control part (19) has rotated to a position where there are three holes (19) aligned with the rods, with the result that two rods bend and three rods do not bend (arrangement shown in FIG. 9). Finally, in FIG. 13, the control part (19) has rotated to a position where there are four holes (19) aligned with the rods, with the result that a single rod bends and the four other rods do not bend.

Figure 14:
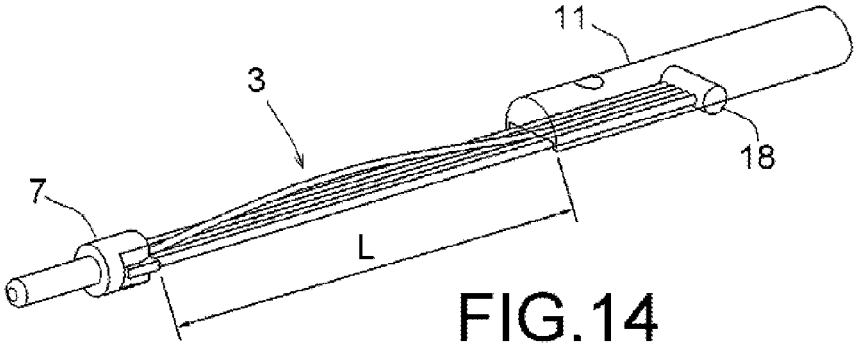
FIGS. 14 and 15 show another embodiment of the invention, adjusted in two different ways.
Figure 15:
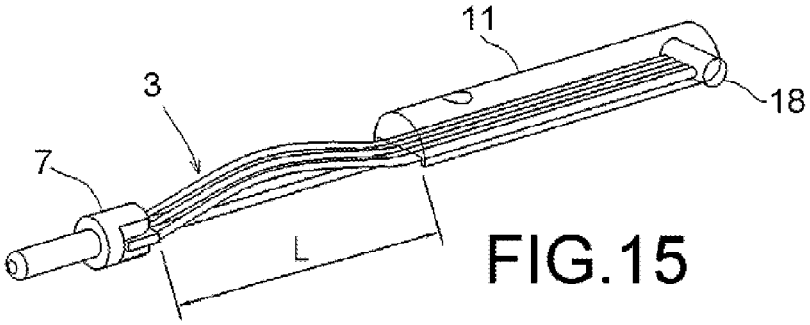

FIGS. 14 and 15 show another embodiment of the invention in which the two preceding concepts are combined (the variation of the point of inertia and the variation of the bending length). The wrench (1) comprises several elongated metal parts (3) in the form of rods and means for selecting both the number of elongated metal parts (3) capable of being bent and the bending length of said metal parts (3). Particularly, a control part (18) and a sliding part (11) such as those described in preceding figures are comprised. In FIG. 14 the wrench is adjusted in such a way that only one rod may be bent and with a large bending length (L), whereas in FIG. 15 the control part (18) and the sliding part (11) are adjusted in such a way that three rods with a smaller bending length (L) may be bent.

Figure 16:
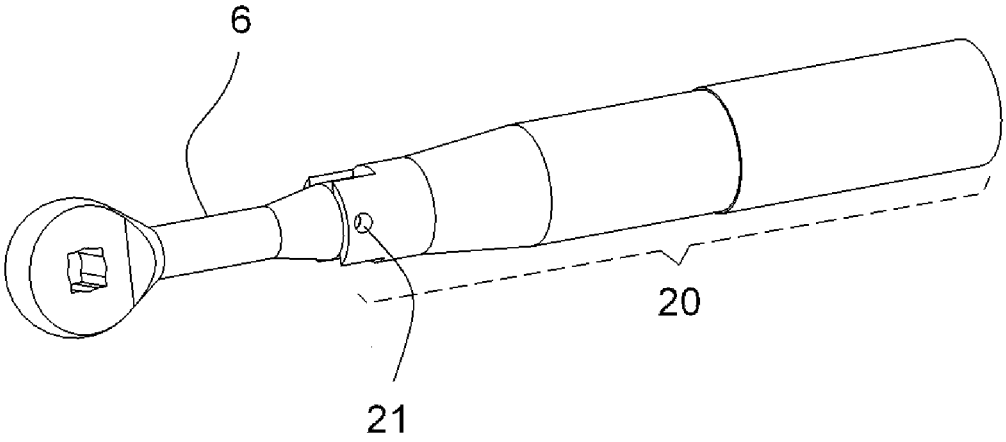
FIGS. 16 and 17 respectively show a perspective and a cross-sectional perspective of another embodiment of the invention.
Figure 17:
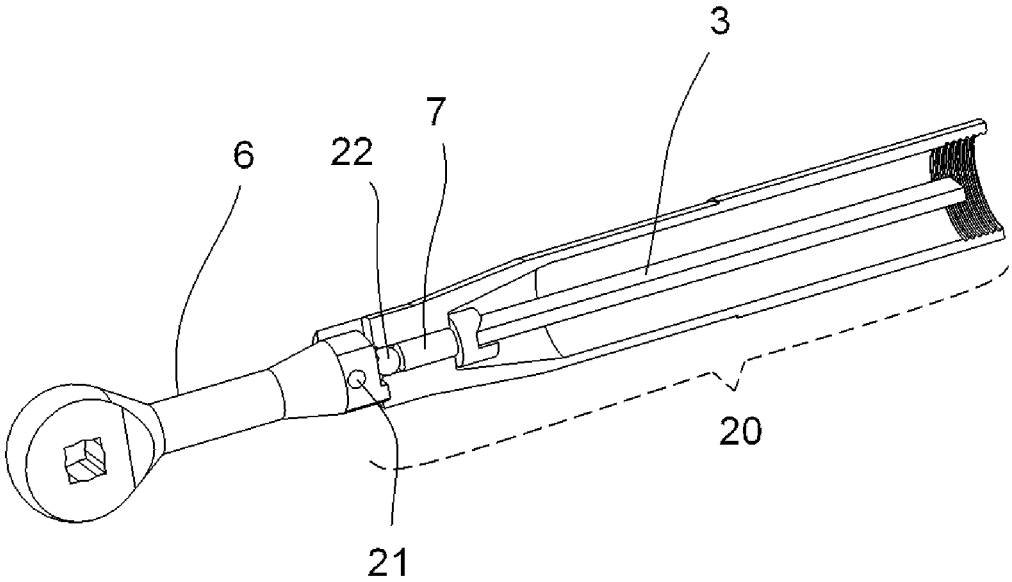
Figure 18:
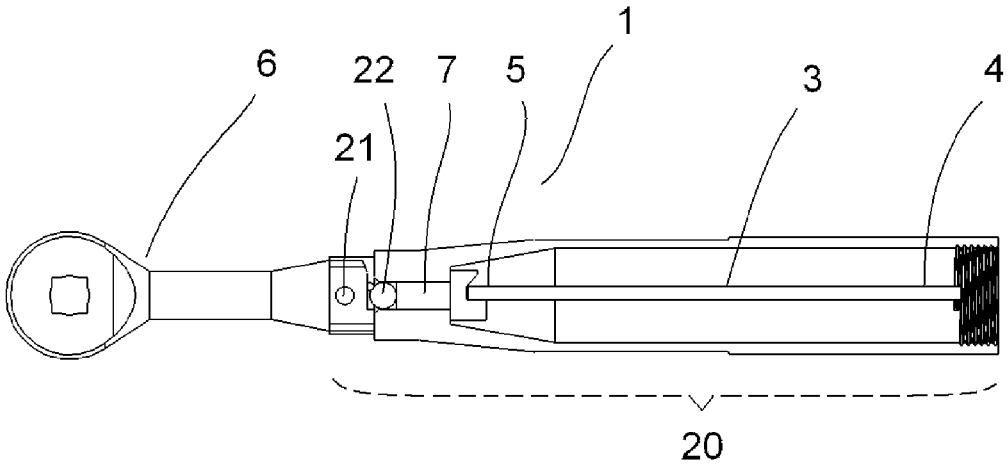
FIGS. 18 and 19 show an elevated cross-sectional view of the wrench of FIGS. 16 and 17 in its initial position and in its position of maximum torque, respectively.
Figure 19:
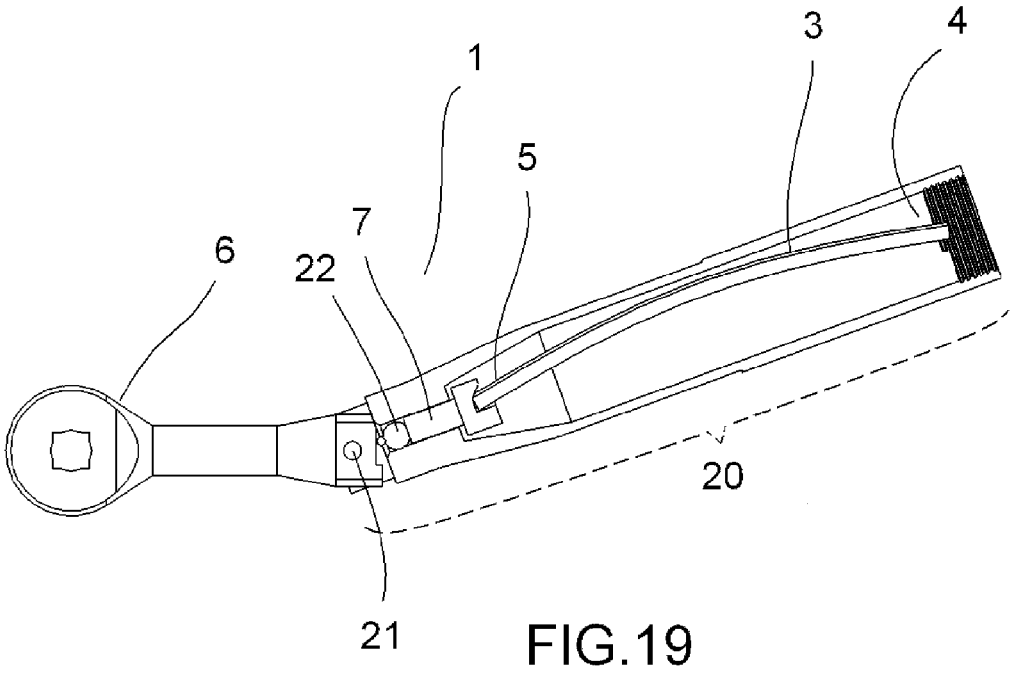
Figure 20:
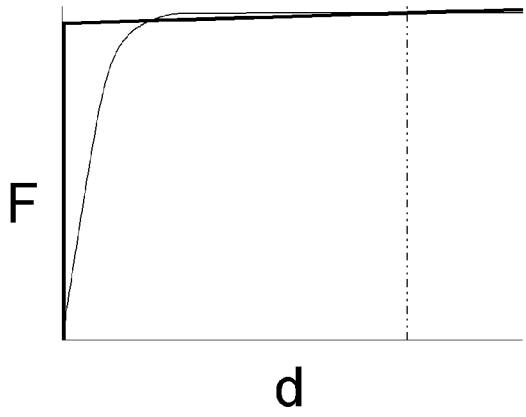
FIG. 20 is a graph showing the force that has to be applied on the spring (the thick stepped line) and on the inventive elongated metal part (the thin curved line) in relation to the required movement or deformation of these parts.

FIGS. 16 and 17 respectively show a perspective and a cross-sectional perspective of yet another embodiment of the wrench (1) according to the invention. In this case the elongated metal part (3) forms part of a set of parts (20) connected by means of an articulated joint (21) to the torque-applying head (6). FIGS. 18 and 19 show an elevated cross-sectional view of the wrench (1) in its initial position and in its position of maximum torque respectively.

This embodiment works as follows. The user starts to use the wrench (1) in the position shown in FIG. 18, in which the set of parts (20) are aligned with the torque-applying head (6). As the user exerts a increasing force, i.e. as the wrench (1) applies an increasing torque, the set of parts (21) starts to rotate in relation to the torque-applying head (6) and the elongated metal part (3) starts to bend, i.e., buckle. The elongated metal part (3) then reaches its maximum bending, i.e., buckling, point and the set of parts (21) is no longer able to continue rotating in relation to the torque-applying head (6) (a situation shown in FIG. 19). At this point the wrench (1) indicates that it has reached its maximum torque.

In this embodiment, therefore, the point at which maximum torque has been reached is indicated by the set of parts (20) rotating in relation to the torque-applying head (6) to the angle of maximum rotation, and not by a "click" or other indication emitted by the torque-applying head, as in the preceding embodiment. In addition, the point where the torque is applied (which is located approximately in the articulated joint (21), in other words right where the pusher member (7) acts) is situated further away from the axis of rotation of the external part (a screw, a nut, etc.) on which torque is to be provided. It is for this reason that, in providing a certain torque, the elongated metal part (3) should not bend as much in this embodiment as in the preceding embodiment.

In this embodiment the torque is applied on the area of the articulated joint (21), instead of on the catch (17) and the gearwheel (16) of the torque-applying head (6) as was the case in the embodiment shown in the preceding figures. This makes the construction of the wrench (1) easier, as the shape of the parts related to the articulated joint (21) is such that these parts can be relatively easily and cost-effectively manufactured from hard materials (which in turn are able to withstand high torques); the rest of the wrench (1) can be manufactured using materials with a standard hardness.

In the embodiment shown in FIGS. 16 to 19, the articulated joint (21) is formed by a set of balls (22), although the invention is not limited in this sense and contemplates many alternative or additional embodiments.

The invention claimed is:

1. A wrench (1) for providing a maximum torque to an external part, comprising:

at least one elongated metal part (3) provided with a fixed end (4) and a pusher end (5), wherein the elongated metal part (3) is configured to buckle when torque is applied with the wrench, and wherein the elongated metal part (3) reaches a maximum buckling point that determines the maximum torque provided by the wrench (1), a torque-applying head (6) upon which the pusher end (5) acts, and a sliding part (11) operable to select the buckling length of the elongated metal part (3) and, as a result, vary the maximum torque provided by the wrench (1), the sliding part (11) being configured to be slidable over and relative to the elongated metal part (3) and press the elongated metal part (3) at a variable point (P), the sliding part (11) being configured to be operated on the outside of the wrench (1), and a moving cover (13) that is engaged with the bolt (12) and which causes said bolt (12) to move, wherein the moving cover (13) presents a helicoidal groove (14) in which the bolt (12) moves, with the result that a rotation of the moving cover (13) causes the bolt (12) to move axially.

2. The wrench (1), according to claim 1, wherein the helicoidal groove (14) presents a fixed pitch.

3. The wrench (1), according to claim 1, wherein the helicoidal groove (14) presents a variable pitch.

4. The wrench (1), according to claim 1, further comprising a bolt (12) configured and disposed to operate the sliding part (11) on the outside of the wrench (1).

5. The wrench (1), according to claim 1, wherein the elongated metal part has a movable first end and a fixed second end, and when the elongated metal part buckles in use, the movable first end of the elongated metal part moves towards the fixed second end longitudinally without moving transversely, and the elongated metal part bulges (buckles) transversely.

* * * * *